US005867079A

United States Patent [19]

Duchemin et al.

[11] Patent Number: 5,867,079

[45] Date of Patent: Feb. 2, 1999

[54] ELECTROMAGNETIC SWITCHING APPARATUS

[75] Inventors: Jean-Pierre Duchemin, Jouy-le-Moutier; Bruno Jacquet, Mantes la Ville; Régis Perrocheau, Jouy-le-Moutier, all of France

[73] Assignee: Schneider Electric SA, Boulogne Billancourt, France

[21] Appl. No.: 897,951

[22] Filed: Jul. 24, 1997

[30] Foreign Application Priority Data

Jul. 24, 1996 [FR] France ..... 96 09413

[51] Int. Cl.[6] ..... H01H 67/02

[52] U.S. Cl. ..... 335/132; 335/202

[58] Field of Search ..... 335/132, 202, 335/167–76, 23–25

[56] References Cited

FOREIGN PATENT DOCUMENTS 34 02 836 8/1985 Germany .

43 41 330 4/1995 Germany .

*Primary Examiner*—Lincoln Donovan

*Attorney, Agent, or Firm*—Oblon, Spivak, McClelland, Maier & Neustadt, P.C.

[57] ABSTRACT

An electromagnetic switching device including, in an envelope formed by a base (1) and an insulating casing (7), a contact holder (3) in which are housed contact bridges (4) featuring a moving lock (8) capable of immobilizing the contact holder (3), wherein the lock (8) and the insulating casing (7) have sliding assembly devices (74, 75) which move the lock (8) positively from the rest position towards the contact holder (3) in the locked position by moving the insulating casing (7) away from the base, and the sliding assembly devices (74, 74) move the lock (8) away from the contact holder positively from the locked position by moving the casing towards the base.

6 Claims, 2 Drawing Sheets

ELECTROMAGNETIC SWITCHING APPARATUS

BACKGROUND OF THE INVENTION

1. Field of the Invention

This invention relates to an electromagnetic switching apparatus, and more particularly to a contactor, comprising, in a housing formed by a base and an insulating casing, a contact holder in which are housed contact bridges featuring a moving lock capable of locking the contact holder.

The contactors are equipped with contact holders fitted with contact bridges which establish or cut the current when the contact holder is moved by the moving parts of an electromagnet.

2. Discussion of Background

It is known to equip switching apparatus or contactors with locks which can lock the contact holder (e.g., refer to the patent DE 2 549 593, the patent application DE 34 02 836, or the patent DE 43 41 330).

The patent DE 43 41 330 discloses a switching apparatus featuring a contact holder lock fitted with a stop, which co-operates with a stop of the arcing casing, and a spring acting on the contact holder lock. When the arcing casing is removed, the stop is freed and the spring can move the lock from the rest position to the locked position. It is nevertheless possible to remove the casing even though the lock is jammed and cannot move to lock the contact holder. Furthermore, if the contactor is welded, a single ramp system allows the casing to be removed while the poles are established.

SUMMARY OF THE INVENTION

The purpose of the present invention is to ensure that the contact holder is locked, when removing the insulating casing during dismantling, in a positive and safe manner without any particular movements being required. Safety is ensured even after the contacts have been stuck together.

The apparatus of the present invention is characterized by the fact that the lock and the insulating casing have sliding assembly devices which move the lock positively from the rest position towards the contact holder in the locked position by moving the insulating casing away from the base, and the sliding assembly devices move the lock away from the contact holder positively from the locked position by moving the casing towards the base.

In accordance with one characteristic of the present invention, the sliding lock has a mortise which forms two slide grooves which are angled in relation to the translation plane of the contact holder, and the insulating casing has a tenon which forms two angled ramps in the mortise when the insulating casing is fitted onto the base, the axis of this tenon also being angled in relation to the translation plane.

In accordance with one characteristic, the lock is guided near to a partition separating two arcing chambers and is in parallel to the partition, between two contact bridges.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
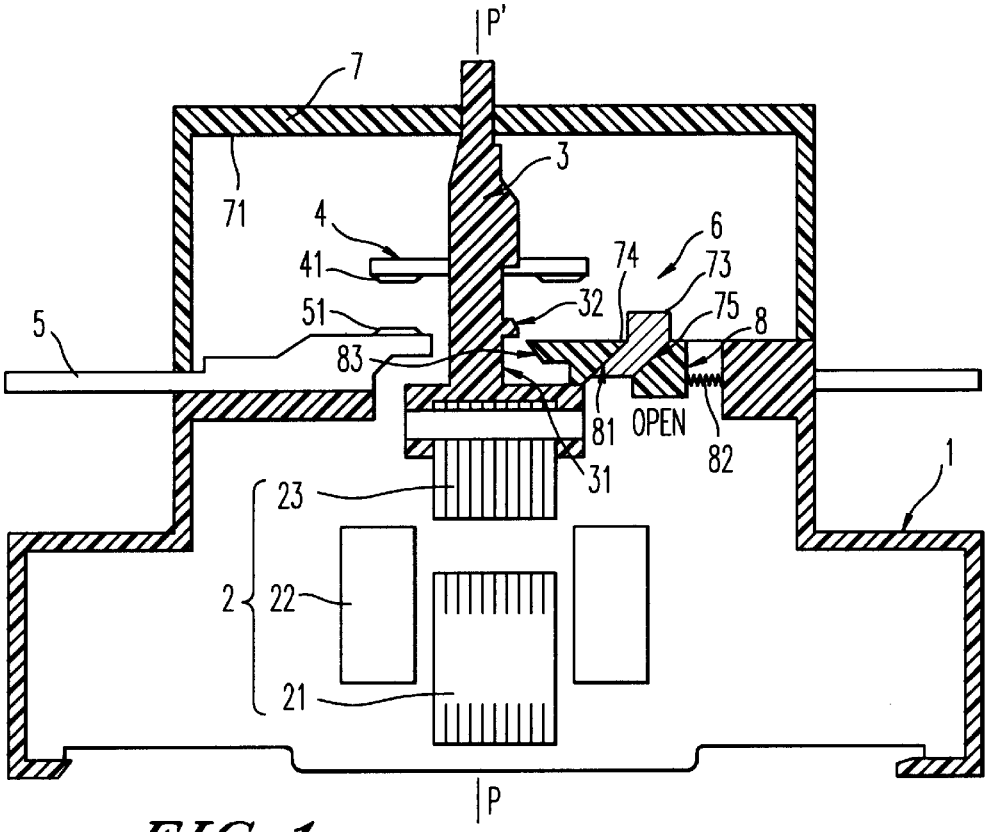
FIG. 1 is a cross sectional view of a contactor in accordance with the invention.

Referring now to the drawings, wherein like reference numerals designate identical or corresponding parts throughout the several views, and more particularly to FIG. 1 thereof, there is illustrated a contactor according to the present invention comprising a housing formed of a base 1 which may be attached to a support (rail, plate) and an insulating casing 7, which may be made of two pieces. The base 1 houses an electromagnet 2 with a fixed yoke 21, a coil 22 and a moving armature 23. The armature 23 is connected to the bottom half of a contact holder 3, which is guided in the insulating casing 7 and the base 1 along a plane P–P'. The top half of the contact holder 3 has several contact bridges 4.

Figure 2:
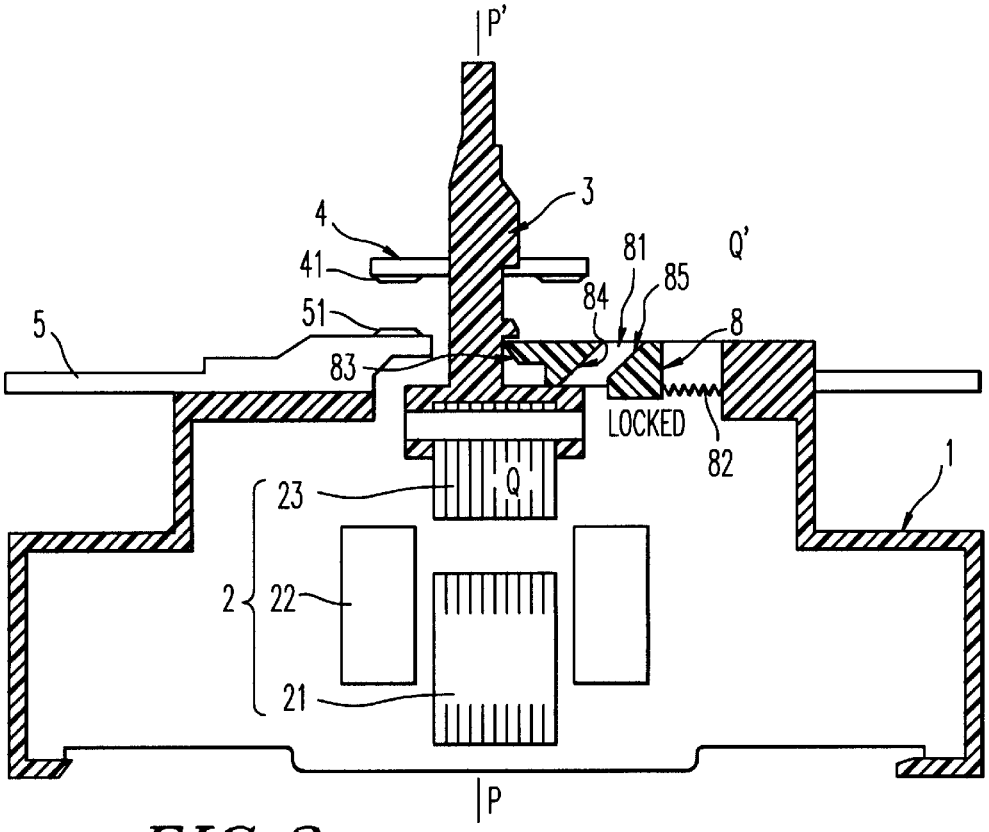
FIG. 2 is a cross sectional view along the same axis as FIG. 1 but in which the arcing casing has been removed and the contact holder is locked.

Each contact bridge 4 has moving contacts 41, which co-operate with fixed contacts 51 mounted on connecting terminals 5 to form a power pole 6 in a sectioning chamber 71 of the insulating casing 7. This insulating casing is fixed, for example, by means of assembly screws or the like, to the base 1. FIG. 2 shows the contactor of the present invention in a locked position.

Figure 3:
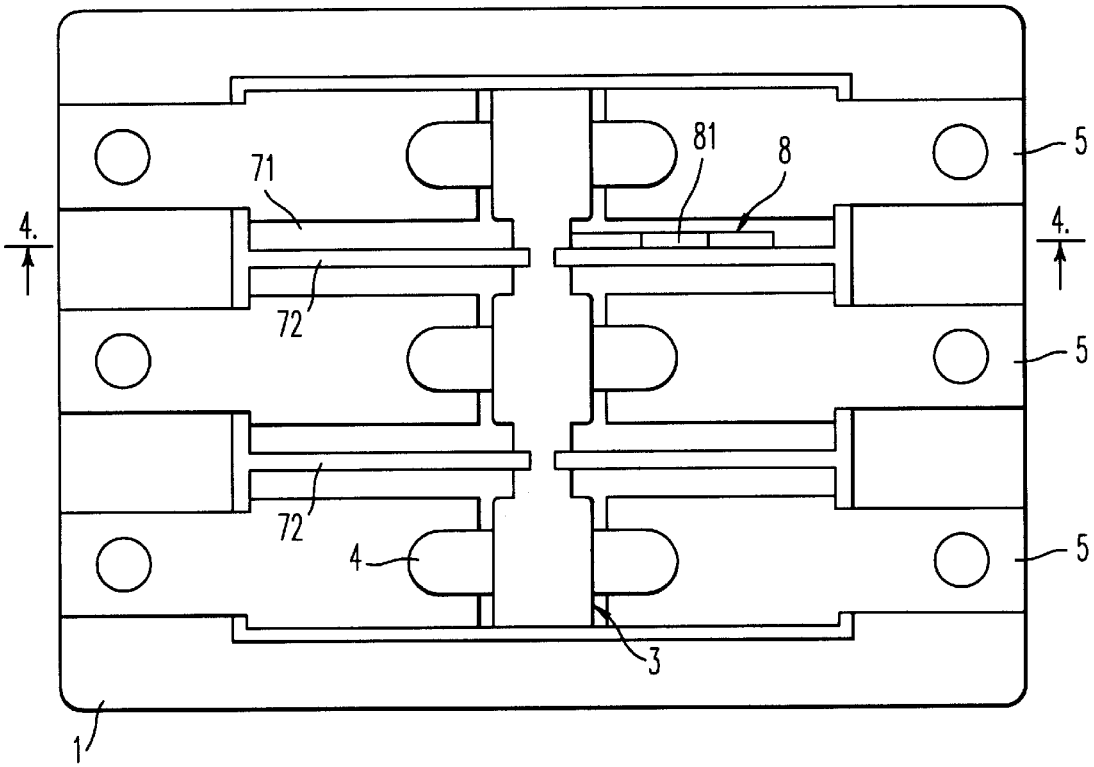
FIG. 3 is a plan view of FIG. 2.
Figure 4:
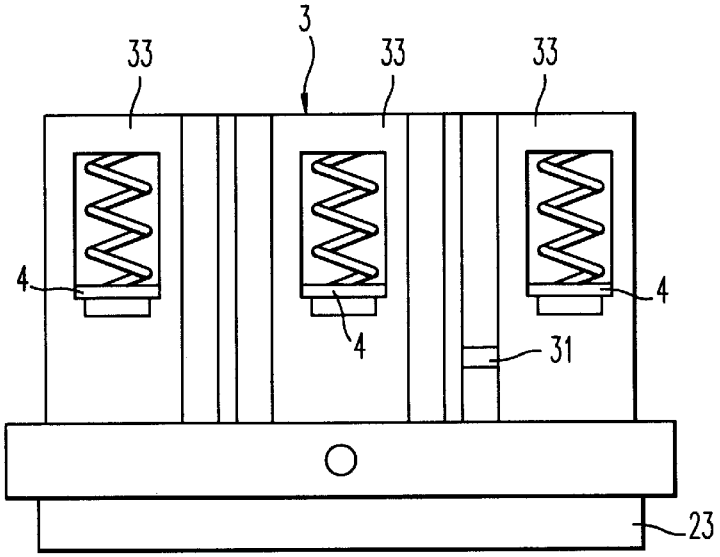
FIG. 4 is an elevation view of the contact holder.

Referring to FIGS. 3 and 4, the contact holder 3 is formed by columns 33 joined by walls, which have grooves in them which slide on the partitions 72 of the insulating casing. These partitions 72 insulate the arcing chambers 71 from each other. Each column 33, of the contact holder 3 has a window in it, which houses a contact bridge 4 and an associated spring.

The contactor has a sliding lock 8 which is guided in the base 1, near to a partition 72 separating two arcing chambers and between two contact bridges 4. The lock 8 is guided in a direction parallel to the partition 72 and perpendicular to the contact holder translation plane P–P'. The end of this lock 8 may be engaged under a tenon 31 on the contact holder 3, so as to immobilize the contact holder 3. This tenon 31 is situated between two columns 33. The lock 8 has a spring 82 (FIGS. 1 and 2) which acts on the lock 8 and which tends to push the lock 8 towards the contact holder 3.

The lock 8 has a mortise 81 which forms two slide grooves 84, 85 (FIGS. 1 and 2) angled along Q–Q' in relation to the translation plane (P–P') of the contact holder (FIG. 2).

The insulating casing 7 has a tenon 73 which forms two angled ramps 74 and 75 (FIG. 1) which respectively slide against the slide grooves 84 and 85 of the mortise 81 when the insulating casing 7 is fitted on the base 1. The axis and ramps 74 and 75 of the tenon are angled along Q–Q' in relation to the translation plane P–P' (FIG. 2).

The tenon 73 is fitted so as to protrude on one side of a partition 72 of the insulating casing 7. The tenon 73 fits into the mortise 81 when the insulating casing 7 is assembled onto the base and the lock 8 of the contact holder 3 is moved clear. When the casing 7 is removed and the tenon 73 is clear of the mortise 81, the tenon 73 moves the lock 8 towards the contact holder 3 as the tenon 73 is lifted (FIG. 1).

The top of the tenon 31 has an angled ramp 32, which allows the lock to be moved clear when the contact holder 3 is raised from the position where the contacts are closed.

The lock 8 presents, on the contact holder side, an angled chamfer 83 which co-operates with the angled ramp 32 (FIG. 1).

The operation of the locking device will now be explained with reference to FIGS. 1–2.

When the insulating casing 7 is attached to the base 1 (FIG. 1), the tenon 73 is engaged with the mortise 81 of the sliding lock 8 and keeps the mortise 81 clear of the contact holder 3, in the rest position, with the spring 82 compressed. With this configuration, the contact holder 3 may be freely activated by the electromagnet.

When the insulating casing 7 is separated from the base 1 (FIG. 2), the ramp 74 and the slide groove 84 move the lock 8 positively from its rest position to its locked position near to the contact holder 3. The end of the lock 8 is engaged in the striking plate 31 and immobilizes the contact holder 3. The spring 82 maintains the lock 8 in this position.

When the insulating casing 7 is put back onto the base 1, the ramp 75 and the slide groove 85 move the lock 8 from the locked position to the rest position (FIG. 1) by compressing the spring 82.

In the case of the contact being welding together, the casing 7 may be removed to allow the user to separate the contacts manually. The contact holder 3 which is then freed can move up again. The angled ramp 32 pushes the sliding lock 8 which can then engage under the tenon 31, without the casing 7 having to be fitted.

Thanks to the double ramp (i.e., formed by angled ramp 32 and angled chamfer 83), one of which acts by locking the contact holder 3 when the casing 7 is removed (i.e., angled chamfer 83), while the other frees the contact holder 3 when it is moved back into place (i.e., angled ramp 32), safety is ensured at all times. The springs are only used to maintain the locked position.

If the contacts 41 and 51 are stuck together, they are freed and opened by force when the casing 7 is removed due to the double ramp (i.e., formed by angled ramp 32 and angled chamfer 83). Safety is therefore ensured.

Obviously, additional modifications and variations of the present invention are possible in light of the above teachings. It is therefore to be understood that within the scope of the appended claims, the invention may be practiced otherwise than as specifically described herein.

What is claimed as new and is desired to be Secured by Letters Patent of the United States is:

1. Electromagnetic switching device, comprising:

a housing having arcing chambers formed by a base and an insulating casing, a contact holder having contact bridges provided in each of the arcing chambers, a moving lock slidably coupled to the base perpendicularly to a translation plane of the contact holder and capable of locking the contact holder, the lock and the insulating casing each have sliding assembly devices which move the lock from a rest position toward the contact holder in a locked position as the insulating casing is moved away from the base, and the sliding assembly devices move the lock away from the contact holder from the locked position as the insulating casing is moved towards the base wherein the sliding assembly devices of the sliding lock include a mortise which forms two slide grooves which are angled in relation to a translation plane of the contact holder, and the sliding devices of the insulating casing include a tenon which forms two angled ramps which slidably couple to the mortise when the insulating casing is fitted onto the base, the axis of said tenon also being angled in relation to the translation plane.

2. The apparatus of claim 1, wherein the lock is provided near a partition separating two arcing chambers of the arcing chambers and parallel to the partition, between two contact bridges of the contact bridges of the arcing chambers.

3. The apparatus of claim 1, wherein the lock engages with a tenon provided on the contact holder.

4. The apparatus of claim 1, wherein the contact holder has an angled ramp which allows the lock to be moved clear of the contact holder when the contact holder is raised from a position where the contact bridges are closed.

5. The apparatus of claim 1, wherein the lock has a spring which forcibly acts upon the lock.

6. The apparatus of claim 4, wherein the lock has an angled chamfer which slidably engages with the angled ramp of the contact holder.

* * * * *